US008506262B2

(12) United States Patent
Leugemors et al.

(10) Patent No.: US 8,506,262 B2
(45) Date of Patent: Aug. 13, 2013

(54) METHODS OF USE FOR A POSITIVE DISPLACEMENT PUMP HAVING AN EXTERNALLY ASSISTED VALVE

(75) Inventors: Edward Leugemors, Needville, TX (US); Rajesh Luharuka, Stafford, TX (US); Toshimichi Wago, Tokyo (JP); Philippe Gambier, La Defense (FR); Jean-Louis Pessin, Amiens (FR); Aparna Raman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 262 days.

(21) Appl. No.: 12/700,302

(22) Filed: Feb. 4, 2010

(65) Prior Publication Data

US 2010/0183448 A1 Jul. 22, 2010

Related U.S. Application Data

(63) Continuation-in-part of application No. 12/113,488, filed on May 1, 2008.

(60) Provisional application No. 60/917,366, filed on May 11, 2007, provisional application No. 60/985,874, filed on Nov. 6, 2007.

(51) Int. Cl.
*F04B 39/10* (2006.01)

(52) U.S. Cl.
USPC ..... 417/298; 417/311; 417/446; 417/503

(58) Field of Classification Search
USPC ..... 417/109, 295, 298, 311, 446, 454, 417/503, 505, 506, 510, 567; 251/65
See application file for complete search history.

(56) References Cited

U.S. PATENT DOCUMENTS

| | | | | |
|---|---|---|---|---|
| 1,633,035 | A | 6/1927 | Reck | |
| 1,759,301 | A | 5/1930 | Dunn et al. | |
| 2,131,749 | A | 10/1938 | Ofeldt | |
| 3,077,836 | A * | 2/1963 | Coberly et al. | 417/206 |
| 3,459,363 | A | 8/1969 | Miller | |
| 3,801,234 | A | 4/1974 | Love et al. | |

(Continued)

FOREIGN PATENT DOCUMENTS

| | | |
|---|---|---|
| EP | 1296061 | 3/2003 |
| EP | 1533516 | 5/2005 |

OTHER PUBLICATIONS

"Solenoid", http://en.wikipedia.org/w/index.php?title=Solenoid&oldid=443790091.

*Primary Examiner* — Charles Freay
*Assistant Examiner* — Patrick Hamo
(74) *Attorney, Agent, or Firm* — Myron Stout; Daryl R. Wright; Tim Curington

(57) ABSTRACT

A method for operating at least one pump in a pump assembly comprises providing a pump assembly comprising a fluid end and a power end, the fluid end in communication with a fluid source and at least one downstream destination and comprising a pump housing for a pressurizable chamber, at least one valve for controlling fluid communication with the chamber, the at least one valve defining a normal duration of allowing fluid communication with the chamber during operation of the pump assembly, providing a valve actuation guide external to the chamber, the valve actuation guide coupled to the valve and operable to assist in controlling fluid communication with the chamber, operating the pump assembly, and actuating the valve actuation guide to change an aspect of the valve duration.

24 Claims, 9 Drawing Sheets

U.S. PATENT DOCUMENTS

| | | | | |
|---|---|---|---|---|
| 3,806,285 | A | | 4/1974 | Sech |
| 4,277,229 | A | | 7/1981 | Pacht |
| 4,432,386 | A | | 2/1984 | Pacht |
| 4,599,054 | A | | 7/1986 | Spears |
| 4,716,924 | A | | 1/1988 | Pacht |
| 4,768,933 | A | | 9/1988 | Stachowiak |
| 5,197,438 | A | | 3/1993 | Kumano et al. |
| 5,409,354 | A | | 4/1995 | Stangroom |
| 5,622,486 | A | | 4/1997 | McDuffie et al. |
| 5,803,122 | A | | 9/1998 | Theilmeier |
| 5,957,674 | A | | 9/1999 | Zenmei et al. |
| 6,045,334 | A | | 4/2000 | Murphy et al. |
| 6,059,539 | A | * | 5/2000 | Nyilas et al. ..... 417/228 |
| 6,651,630 | B2 | | 11/2003 | Hiraku et al. |
| 6,910,871 | B1 | | 6/2005 | Blume |
| 7,299,790 | B2 | | 11/2007 | Okamoto et al. |
| 7,681,589 | B2 | | 3/2010 | Schwegman |
| 2003/0021703 | A1 | | 1/2003 | Wallis |
| 2003/0235508 | A1 | | 12/2003 | Vicars |
| 2006/0147317 | A1 | | 7/2006 | Okamoto et al. |
| 2006/0222518 | A1 | | 10/2006 | Oda et al. |
| 2006/0254357 | A1 | | 11/2006 | Ens et al. |
| 2007/0065302 | A1 | | 3/2007 | Schmitz |
| 2008/0066915 | A1 | | 3/2008 | Shampine |
| 2008/0279705 | A1 | | 11/2008 | Wago et al. |

* cited by examiner

METHODS OF USE FOR A POSITIVE DISPLACEMENT PUMP HAVING AN EXTERNALLY ASSISTED VALVE

CROSS REFERENCE TO RELATED APPLICATIONS

This application is a continuation-in-part application of application Ser. No. 12/113,488, filed on May 1, 2008, which claims priority under 35 U.S.C. §119(e) to U.S. Provisional Application Ser. No. 60/917,366, entitled Valve for a Positive Displacement Pump filed on May 11, 2007, and Provisional Application Ser. No. 60/985,874, entitled Valve for a Positive Displacement Pump filed on Nov. 6, 2007, the disclosures of each of which are incorporated herein by reference in their entirety.

FIELD

Embodiments described relate to valve assemblies for positive displacement pumps used in high pressure applications. In particular, embodiments of positive displacement pumps employing mechanisms and supports for extending the life of pump valves, minimizing pump damage during operation, improving volumetric efficiency, modulating flow rate, and achieving better process control are described.

BACKGROUND

Positive displacement pumps are often employed at oilfields for large high pressure applications involved in hydrocarbon recovery efforts. A positive displacement pump may include a plunger driven by a crankshaft toward and away from a chamber in order to dramatically effect a high or low pressure on the chamber. This makes it a good choice for high pressure applications. Indeed, where fluid pressure exceeding a few thousand pounds per square inch (PSI) is to be generated, a positive displacement pump is generally employed.

Positive displacement pumps may be configured of fairly large sizes and employed in a variety of large scale oilfield operations such as drilling, cementing, coil tubing, water jet cutting, or hydraulic fracturing of underground rock. Hydraulic fracturing of underground rock, for example, often takes place at pressures of 10,000 to 15,000 PSI or more to direct a solids containing fluid through a well to release oil and gas from rock pores for extraction. Such pressures and large scale applications are readily satisfied by positive displacement pumps.

As noted, a positive displacement pump includes a plunger driven toward and away from a pressurizable chamber in order to achieve pumping of a solids containing fluid. More particularly, as the plunger is driven away from the chamber, pressure therein reduces allowing a discharge valve of the chamber to close. The chamber is thus sealed off from the external environment while the plunger remains in communication with the chamber. As such, the plunger continues its retreat away from the chamber generating a lowered pressure with respect to suction therein. Eventually, this lowered pressure will reach a level sufficient to open a suction valve of the pump in order to allow an influx of fluid into the chamber. Subsequently, the plunger may be driven toward the chamber to once again effect a high pressure therein. Thus, the suction valve may be closed, the discharge valve re-opened, and fluid expelled from the chamber as indicated above.

The actuation of the suction and discharge valves is achieved primarily through reliance on pressure conditions generated within the chamber. That is, the amount of pressure required to open or close each valve is a function of the physical characteristics of the valve along with a spring employed to hold the valve in a naturally closed position relative to the chamber. Unfortunately, this results in a lack of direct control over valve actuation and leaves an inherent inefficiency in operation of the valves. For example, opening of a valve requires generation of enough of a pressure change so as to overcome the weight of the valve and nature of its spring. This is of particular note regarding the suction valve where, rather than opening immediately upon closure of the discharge valve, a lowered pressure sufficient to overcome the weight and nature of the suction valve and its spring must first be generated within the chamber (i.e. net positive suction head (NPSH)). This time delay in opening of the suction valve is an inherent inefficiency in operation of the pump. Indeed, for a standard positive displacement pump employed at an oilfield, a pressure of between about 10 PSI and about 30 PSI may be required within the chamber before the suction valve is opened.

Reliance solely upon internal chamber pressure to actuate valves results in an inherent inefficiency and a lack of direct control as indicated above. One such concern is the fact that this manner of valve actuation often leaves the pump itself susceptible to significant damage as a result of cavitation and 'water hammering'. That is, as the plunger moves away from the chamber decreasing pressure therein, the inherent delay in opening of the suction valve may lead to the cavitation and subsequent water hammering as described below.

During the delay in opening of the suction valve, and in conjunction with the generation of lowered pressure in the chamber, the fluid may undergo a degree of cavitation. That is, pockets of vapor may form within the fluid and it may begin to vaporize in the face of the lowered pressure. Formation of vapor in this manner may be followed by rapid compression of the vapor back into liquid as the plunger once again advances toward the chamber. This rapid compression of the liquid is accompanied by a significant amount of heat and may also result in transmitting a degree of shock through the pump, referred to as water hammering. All in all, a significant amount of pump damage may naturally occur based on the pressure actuated design of a conventional positive displacement pump.

In order to address pump damage resulting from cavitation and water hammering, techniques are often employed in which acoustic data generated by the pump is analyzed during its operation. However, reliance on the detection of acoustic data in order to address pump damage fails to substantially avoid the development of pump damage from cavitation and water hammering in the first place. Furthermore, it is not uncommon for the damaged pump to be employed in conjunction with an array of additional pumps at an oilfield. Thus, the damage may see its effects at neighboring pumps, for example, by placing added strain on these pumps or by translation of the damaging water hammering effects to these pumps. Indeed, cascading pump failure, from pump to pump to pump, is not an uncommon event where a significant amount of cavitation and/or water hammering is found.

It is desirable to improve the operation and reliability of pumps, such as those comprising at least one active valve controlling for suction/discharge. It is desirable to improve the volumetric efficiency of pumps, reduce the likelihood of valve wear, and improved control of the pump operation including, but not limited to, the ability to control the volume output of the pump.

SUMMARY

A method for operating at least one pump in a pump assembly comprises providing a pump assembly comprising a fluid end and a power end, the fluid end in communication with a fluid source and at least one downstream destination and comprising a pump housing for a pressurizable chamber, at least one valve for controlling fluid communication with the chamber, the at least one valve defining a normal duration of allowing fluid communication with the chamber during operation of the pump assembly, providing a valve actuation guide external to the chamber, the valve actuation guide coupled to the valve and operable to assist in controlling fluid communication with the chamber, operating the pump assembly, and actuating the valve actuation guide to change an aspect of the valve duration. In an embodiment, actuating further comprises changing an operating property of one of the pump assembly and a downstream destination. In an embodiment, actuating comprises reducing the valve duration below the normal valve duration. In an embodiment, actuating comprises increasing the valve duration above the normal valve duration.

In an embodiment, actuating comprises delaying the valve duration with respect to the normal valve duration. In an embodiment, actuating comprising accelerating the valve duration with respect to the normal valve duration. In an embodiment, providing a valve actuation guide comprises providing an electromagnetic power source coupled to at least one electromagnetic inductor and wherein the valve is of a magneto-responsive material. In an embodiment, providing a valve actuation guide comprises providing a mechanical arm disposed between the valve and the valve actuation guide, the mechanical arm coupling the valve and valve actuation guide. In an embodiment, actuating changes an operating property in the fluid end in the pump. In an embodiment, actuating changes a pumping rate of the pump assembly. In an embodiment, actuating changes a torque output of the pump assembly. In an embodiment, actuating changes a vibration output of the pump assembly.

In an embodiment, actuating comprises deactivating at least one of the valves and performing at least one diagnostic test on the pump assembly. The diagnostic test may comprise a one of a pressure test and a leak test. In an embodiment, actuating comprises actuating the valve to deactivate the chamber. Deactivating may comprise deactivating the chamber in response to a signal from the pump assembly. In an embodiment, actuating creates a pressure pulse to the at least one downstream destination. The pressure pulse may be utilized for sending a telemetric pressure signal to the at least one downstream destination. In an embodiment, actuating changes a suction head of the pump assembly. In an embodiment, actuating allows the chamber to be primed with the fluid source.

An embodiment of a method for operating at least one pump in a pump assembly comprises providing a pump assembly comprising a fluid end and a power end, the fluid end in communication with a fluid source and at least one downstream destination and comprising a pump housing defining a plurality of cylinders each pressurizable by a piston driven by the power end, at least a pair of valves for controlling fluid communication to and from the cylinders, the valves defining a normal duration of controlling fluid communication with the chamber during operation of the pump assembly, the fluid end, providing a valve actuation guide external to the chamber, the valve actuation guide coupled to at least one of the valves and operable to assist in controlling fluid communication with the chamber, operating the pump assembly, and actuating the valve actuation guide to change an aspect of the valve duration and change an operating property of the pump assembly. In an embodiment, actuating changes an operating property of a downstream destination.

An embodiment of a method for operating at least one pump in a pump assembly comprises providing a pump assembly, the pump assembly comprising a fluid end in communication with a fluid source and at least one downstream destination and comprising a pump housing defining a plurality of cylinders, and at least one suction valve and one discharge valve for controlling fluid communication to and from the cylinders, and a piston disposed in the cylinders for pressurizing the cylinders and a power end for driving the pistons, the suction and discharge valves defining a normal duration of controlling fluid communication with the cylinder during operation of the pump assembly, providing a valve actuation guide external to at least one of the cylinders, the valve actuation guide coupled to one of the suction valve and the discharge valve and operable to assist in controlling fluid communication with the cylinder, operating the pump assembly, and actuating the valve actuation guide to change an aspect of the valve duration. In an embodiment, actuating changes an operating property of one of the pump assembly and a downstream destination. In an embodiment, the fluid source comprises an oilfield fluid and the at least one downstream destination comprises a wellbore. In an embodiment, the method further comprises routing the oilfield fluid to the wellbore and performing at least one well services operation.

An embodiment of a positive displacement pump is provided with a housing for a pressurizable chamber. The chamber may be defined in part by a valve thereof which may be employed for controlling fluid access to the chamber. The positive displacement pump may also include a valve actuation guide that is positioned at least partially external to the chamber and coupled to the valve so as to assist the controlling of the fluid access to the chamber.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Embodiments are described with reference to certain high pressure positive displacement pump assemblies for fracturing operations. However, other positive displacement pumps may be employed for a variety of other operations including cementing. Regardless, embodiments described herein employ positive displacement pumps with valves that are equipped with external actuation assistance. As such, valve actuation is not left solely to the buildup of cavitation-inducing conditions within a chamber of the pump which would have the potential to create significant pump damage through water hammering.

Figure 1:
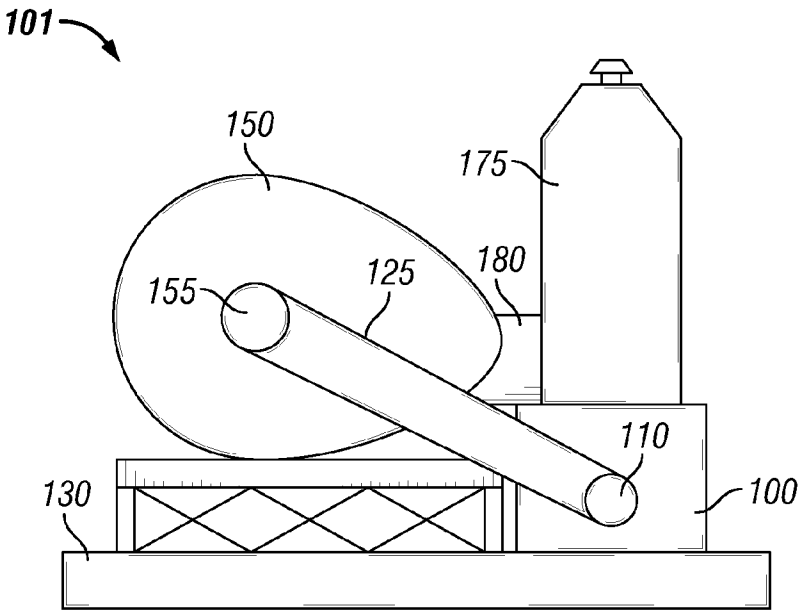
FIG. 1 is a side view of an embodiment of a positive displacement pump employing a valve actuation guide assembly.

Referring now to FIG. 1, an embodiment of a positive displacement pump 101 is shown which may employ a valve actuation guide assembly 100. The pump 101 may include a power supply depicted as a crankshaft housing 150 coupled to a plunger housing 180 which is in turn coupled to a chamber housing 175. In the embodiment shown, the pump components may be accommodated at a conventional skid 130 to enhance mobility, for example, for placement at an oilfield 501 (see FIG. 5). However, in other embodiments a pump truck or alternatively less mobile pump configurations may be employed. Additionally, the pump 101 may be of a conventional triplex configuration as depicted. However, other positive displacement pump configurations, such as, but not limited to, a quintuplex configuration wherein the pump 101 comprises five plungers and cylinders, may also be employed.

Figure 2:
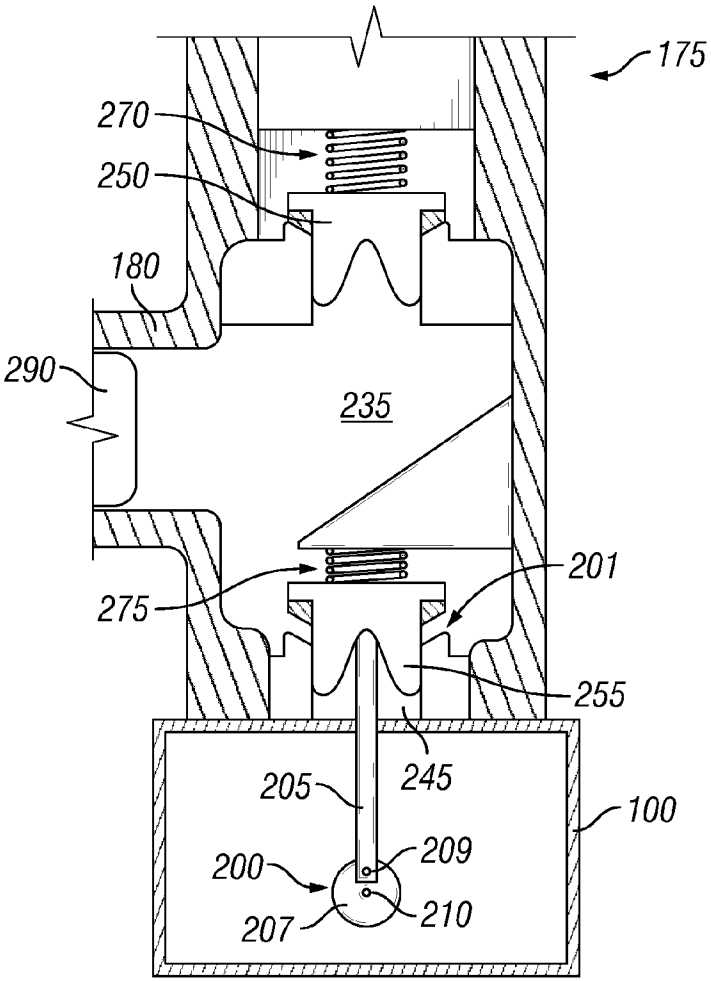
FIG. 2 is a cross-sectional view of the pump of FIG. 1 revealing an embodiment of a valve actuation guide of the assembly.

Continuing with reference to FIGS. 1 and 2, the chamber housing 175 of the pump 101 may be configured with valves (250, 255) to draw in, pressurize, and dispense an operation fluid. However, as indicated, the valve actuation guide assembly 100 may also be provided which is coupled to the chamber housing 175. The guide assembly 100 may be configured to assist valves (e.g. 250) in controlling or regulating fluid ingress and egress relative to the chamber housing 175. As detailed herein-below, this valve assistance provided by the guide assembly 100 may minimize pump damage during operation and enhance overall efficiency of the pump 101.

With particular reference to FIG. 2, a valve actuation guide 200 of the guide assembly 100 may be configured to assist in actuation of a valve 255 of the chamber housing 175. In the embodiment shown, the valve actuation guide 200 is mechanically coupled to the suction valve 255 of the chamber housing 175. However, in other embodiments, a valve actuation guide may similarly be coupled to the discharge valve 250 of the housing 175 or other valves not depicted. Additionally, as depicted in FIG. 2, the valve actuation guide 200 may be of a crank-driven configuration as described further below. However, in other embodiments, hydraulic, electromagnetic, or other valve actuation assistance may be employed.

Continuing with reference to FIGS. 1 and 2, the pump 101 is provided with a plunger 290 reciprocating within a plunger housing 180 toward and away from a pressurizable chamber 235. In this manner, the plunger 290 effects high and low pressures on the chamber 235. For example, as the plunger 290 retreats away from the chamber 235, the pressure therein will decrease. As the pressure within the chamber 235 decreases, the discharge valve 250 may close returning the chamber 235 to a sealed state. As the plunger 290 continues to move away from the chamber 235 the pressure therein will continue to drop, and eventually a lowered pressure may begin to arise within the chamber 235.

In spite of the potential development of lowered pressure within the chamber 235 as indicated above, significant cavitation may be avoided. That is, valve actuation assistance may be provided to the suction valve 255 to effect its opening as depicted in FIG. 2. As shown, the valve actuation guide 200 may be employed to ensure that the suction valve 255 is raised in order to allow a communication path 201 between a supply 245 of operation fluid and the chamber 235. As such, the uptake of operation fluid may be achieved without sole reliance on lowered pressure overcoming a suction spring 275. Thus, significant vaporization of operation fluid within the chamber 235 may be avoided.

Avoidance of significant vaporization of operation fluid in this manner may substantially minimize the amount of pump damage that may otherwise result as the plunger 290 repressurizes and condenses the operation fluid. That is, water-hammering damage due to the rapid condensing of vaporized operation fluid may be largely avoided. As such, in the embodiment shown, the plunger 290 may be thrust toward the chamber 235, increasing the pressure therein. The pressure increase will ultimately be enough to effect opening of the discharge valve 250 overcoming the force supplied by the discharge spring 270.

In an embodiment where the pump 101 is to be employed in a fracturing operation, pressures may be achieved in the manner described above that exceed about 2,000 PSI, and more preferably, that exceed about 10,000 PSI or more. Furthermore, such a positive displacement pump 101 is particularly well suited for high pressure applications of abrasive containing operation fluids. In fact, embodiments described herein may be applied to cementing, coil tubing, water jet cutting, and hydraulic fracturing operations as indicated, to name a few.

As indicated, the valve actuation guide 200 is configured to assist in actuation of the suction valve 255 as detailed above. However, the valve actuation guide 200 may take a variety of configurations in order to provide such assistance. For example, in the particular embodiment of FIG. 2, the valve actuation guide 200 is of a crank-driven configuration. As such, an arm 205 is provided extending from the suction valve 255 away from the chamber 235 and to the guide assembly 100. In the embodiment shown, the arm 205 is coupled to a rotatable crankshaft 207 through a pin 209. The crankshaft 207 is rotatable about a central axis 210. Thus, as the crankshaft 207 rotates, it serves to raise and lower the arm 205. In this manner, actuation of the suction valve 255 is achieved based on the rotation of the crankshaft 207 as opposed to sole reliance on lowered pressure within the chamber 235 as indicated above.

As indicated above, the proper timing for actuation of the suction valve 255 is dependent upon the position of the plunger 290, relative to the chamber 235. Thus, as described below, a mechanism for synchronizing the timing of the valve actuation guide 200 and its crankshaft 207 with the plunger 290 may be provided. Additionally, in the embodiment shown, the arm 205 is reciprocated in a rectilinear manner so as to maintain isolation between the guide assembly 100 and the operation fluid supply 245. This may be achieved through the employment of a crankshaft 207 of a conventional rectilinear effectuating crank design. Alternatively, other methods of sealing between the guide assembly 100 and the operation fluid supply 245 may be employed or a tolerable degree of communication there-between may be allowed.

As indicated above, and with added reference to FIG. 1, a mechanism for synchronizing the timing of the valve actuation guide 200 and the plunger 290 may be provided. As depicted in FIG. 1, the positive displacement pump 101 includes a timing mechanism in the form of a timing belt 125 running between the crankshaft housing 150 and the valve actuation guide assembly 100. More particularly, the timing belt 125 is positioned between a crank gear 155 at the crankshaft housing 150 and an assembly gear 110 at the guide assembly 100. The crank gear 155 may be coupled to the crankshaft of the crankshaft housing 150 which drives the plunger 290. By contrast, the assembly gear 110 may be coupled to the crankshaft 207 of the guide assembly 100. Thus, rotation of the crankshaft of the crankshaft housing 150 drives the plunger 290 as indicated, while also driving the valve actuation guide 200. Therefore, with appropriately sized intervening gears 155, 110 and other equipment parts, precise synchronized timing of the valve actuation guide 200 in line with the reciprocating plunger 290 may be achieved. Additionally, in other embodiments, the valve actuation guide 200 may be mechanically linked to the power output of the pump 101 through alternate means. Regardless, the volumetric efficiency of the pump operation may be enhanced in addition to the substantial elimination of cavitation and pump damage as described above with such a degree of synchronization employed.

Continuing with reference to FIG. 2, the arm 205 of the valve actuation guide 200 is depicted as a monolithic linkage between the suction valve 255 and the rotable crankshaft 207. However, in one embodiment the arm 205 may be contractible, similar to a conventional shock absorber. In this manner, the suction valve 255 may continue to be pressure actuated based on pressure within the chamber 235 in the event that the rotable crankshaft 207 ceases rotation or otherwise fails to properly operate. For example, with a contractible arm 205, the suction valve 255 may avoid being stuck in an open position as depicted in FIG. 2 should the valve actuation guide 200 malfunction or cease to operate.

The valve actuation guide 200 described above includes a crankshaft 207 for actuating the suction valve 255 in both an open direction, as depicted in FIG. 2, as well as in a closed direction (e.g. when the plunger 290 returns toward the chamber 235). However, this type of external valve assistance may take place to greater or lesser degrees. For example, in one embodiment, the valve actuation guide 200 may include a rotable cam in place of the rotable crankshaft 207. Thus, the arm 205 may be forced upward by the cam during its rotation in order to open the valve 255. However, returning closed of the valve 255 may be left to pressure buildup within the chamber 235 and/or spring 275. Thus, significant cavitation may be avoided as the suction valve 255 is opened without sole reliance on lowered pressure within the chamber 235. As such, employing a return of higher pressure within the chamber to close the suction valve 255 is less likely to result in any significant water hammering.

Similarly, the embodiments depicted reveal the guide assembly 100 and actuation guide 200 adjacent only to the suction valve 255. That is, actuation of the discharge valve 250 is left to pressure conditions within the chamber 235. This may allow for ease of design similar to cam actuation noted above and may be a practical option in light of the fact that significant cavitation is unlikely correlated to any discharge valve 250 position. However, in an embodiment external assistance is provided to the discharge valve 250 in addition to the suction valve 255. That is, an additional actuation guide similar to the embodiments described above may be positioned adjacent the discharge valve 250 and coupled thereto in order to further enhance pump efficiency. This may take place by reducing the amount of time that might otherwise be required to open or close the discharge valve 250 based solely on the pressure within the chamber 235.

Figure 3:
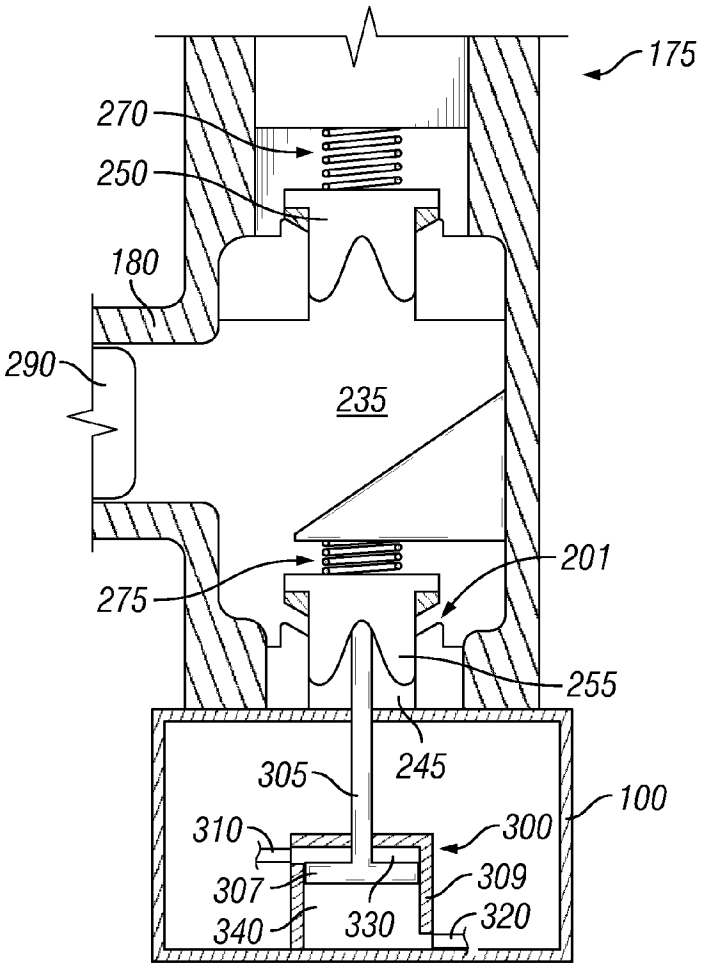
FIG. 3 is a cross-sectional view of the pump of FIG. 1 revealing an alternate embodiment of a valve actuation guide of the assembly.

Referring now to FIG. 3, an embodiment of an actuation guide 300 is depicted within the guide assembly 100. Namely, a hydraulic actuation guide 300 may be employed in order to provide external assistance to a valve such as the depicted suction valve 255. In the embodiment shown, an arm 305 once again extends from the suction valve 255 to the external guide assembly 100 where it terminates at a plate 307 within a hydraulic chamber 309. As described below, hydraulic fluid within the chamber 309 may act upon the plate 307 in order to effect reciprocation of the arm 305. In this manner, the suction valve 255 may be assisted in either opening to the position shown in FIG. 3 or in closing.

Continuing with reference to FIG. 3, the actuation guide 300 includes the noted hydraulic chamber 309 which may be divided into a pump-side interior compartment 330 and an exterior compartment 340 at either side of the plate 307. Thus, an increase in pressure at the interior compartment may be employed to drive the arm 305 away from the adjacent pump equipment. In the case of the suction valve 255 coupled to the arm 305, this pressure increase results in a closing of the valve 255 and the communication path 201 between the fluid supply 245 and the pump chamber 235. Alternatively, a pressure increase within the exterior compartment 340 may act upon the opposite side of the plate 307 to drive the suction valve 255 into the open position depicted in FIG. 3. Of note is the fact that in an embodiment where a hydraulic actuation guide 300 is also coupled to the discharge valve 250, an increase in pressure at its pump side interior compartment would act to open the valve 250. Alternatively, an increase in pressure at the opposite exterior compartment would act to close the valve 250. This manner of actuation would be due to the unique orientation of the discharge valve 250 relative to the pump chamber 235.

Returning to the embodiment depicted in FIG. 3, the interior compartment 330 is served by an interior hydraulic line 310 whereas the exterior compartment is served by an exterior hydraulic line 320. Thus, in one embodiment a double acting hydraulic control mechanism may be disposed between the lines 310, 320 to drive hydraulic fluid between the lines 310, 320 in order to regulate pressure within the compartments 330, 340 as described. Alternatively, synchronized independently actuated double acting pneumatic actuators may be coupled to each line 310, 320 in order to direct pressures within the compartments 330, 340 and achieve reciprocation of the arm 305.

Similar to the crank-driven configuration of FIG. 2, the hydraulic valve actuation guide 300 of FIG. 3 provides valve actuation assistance to the suction valve in a manner substantially reducing cavitation or boiling of operation fluid within the chamber 235 during retreat of the plunger 290. Additionally, where the actuation guide 300 assists in both opening and closing of the suction valve 255 in a synchronized manner, volumetric efficiency of the pump is also enhanced. Furthermore, additional volumetric efficiency may be achieved in an embodiment where a hydraulic actuation guide 300 is also coupled to the discharge valve 250 as described above.

As in the case of the crank-driven configuration of FIG. 2, the arm 305 may also be of a shock-absorber configuration to ensure continued valve operation in the event of breakdown of the actuation guide 300. Additionally, the hydraulic actuation guide 300 may be employed for assistance in valve actuation in a single direction (e.g. opening of the suction valve 255 similar to the cam actuated embodiment described above).

Figure 4:
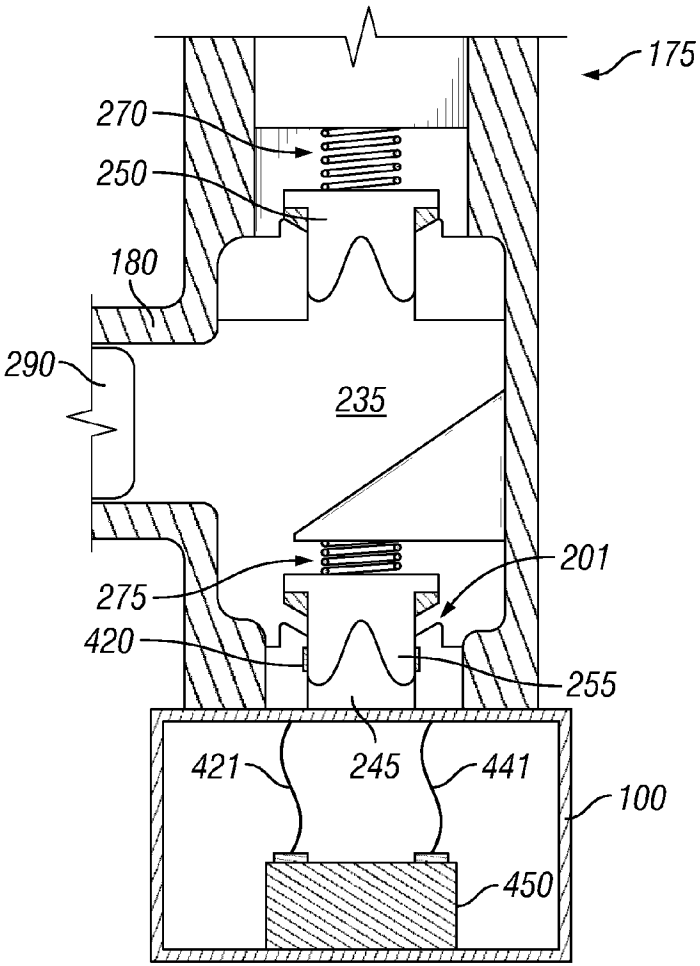
FIG. 4 is a cross-sectional view of the pump of FIG. 1 revealing another alternate embodiment of a valve actuation guide of the assembly.

Continuing now with reference to FIG. 4, an embodiment of an actuation guide 450 is depicted within the guide assembly 100. In this case, the actuation guide is an electromagnetic power source that is wired through leads 421, 441 to an electromagnetic inductor 420. Thus, in the embodiment shown, the suction valve 255 may be of a conventional magnetic or other magneto-responsive material such that valve actuation may be directionally assisted based on the polarity of the inductors 420. That is, the inductor 420 may be of reversible polarity such that the valve 255 will either be assisted in opening or closing depending on the magnitude and polarity of the current through the inductor 420.

In the embodiment of FIG. 4, the actuation guide 450 remains entirely free of physical coupling to the suction valve 255 by way of imparting electromagnetic forces through the inductor 420 imbedded within the seat below the suction valve 255 and adjacent the fluid supply 245. However, in another embodiment, an arm similar to that of FIGS. 2 and 3 may be coupled to the valve 255 and extend toward the guide assembly 100. In such an embodiment, an inductive mechanism may be retained isolated from the fluid supply 245 where desired. Thus, the arm, as opposed to the valve 255 itself, may be made up of magnetic or magneto-responsive material and acted upon by the inductive mechanism to assist valve actuation similar to the mechanical and hydraulic embodiments depicted in FIGS. 2 and 3.

As with prior embodiments detailed above, the electromagnetic driven configuration of FIG. 4 provides valve actuation assistance to the suction valve in a manner substantially reducing cavitation. Additionally, where the actuation guide 450 induces a synchronized reverse of polarity to assist in both opening and closing of the suction valve 255, volumetric efficiency of the pump is also enhanced. Furthermore, additional volumetric efficiency may be achieved in an embodiment where an electromagnetic actuation guide 450 is also coupled to the discharge valve 250.

With particular reference to FIGS. 3 and 4, hydraulic and electromagnetic valve actuation assistance may be particularly well suited for non-mechanical synchronization with the power output of the pump. That is, rather than physically employing a timing belt 125 to link power output and the guide assembly 100, the position of the plunger 290 or other pump parts may be monitored via conventional sensors and techniques. This information may then be fed to a processor where it may be analyzed and employed in actuating the hydraulic 300 or electromagnetic 450 actuation guides employed. Indeed, with such techniques available, actuation assistance may be tuned in real-time to ensure adequate avoidance of cavitation and maximization of volumetric pump efficiency.

Continuing with reference to the embodiments of FIGS. 3 and 4, non-intrusive actuation assistance in the form of hydraulic 300 or electromagnetic 450 actuation guides provides additional advantages. For example, there is a reduction in the total number of mechanical moving parts which must be maintained. Indeed, in the case of electromagnetic actuation, in particular, the option of eliminating an arm coupled to the valve 255 alleviates concern over the potential need to maintain a sealed off fluid supply 245.

Figure 5:
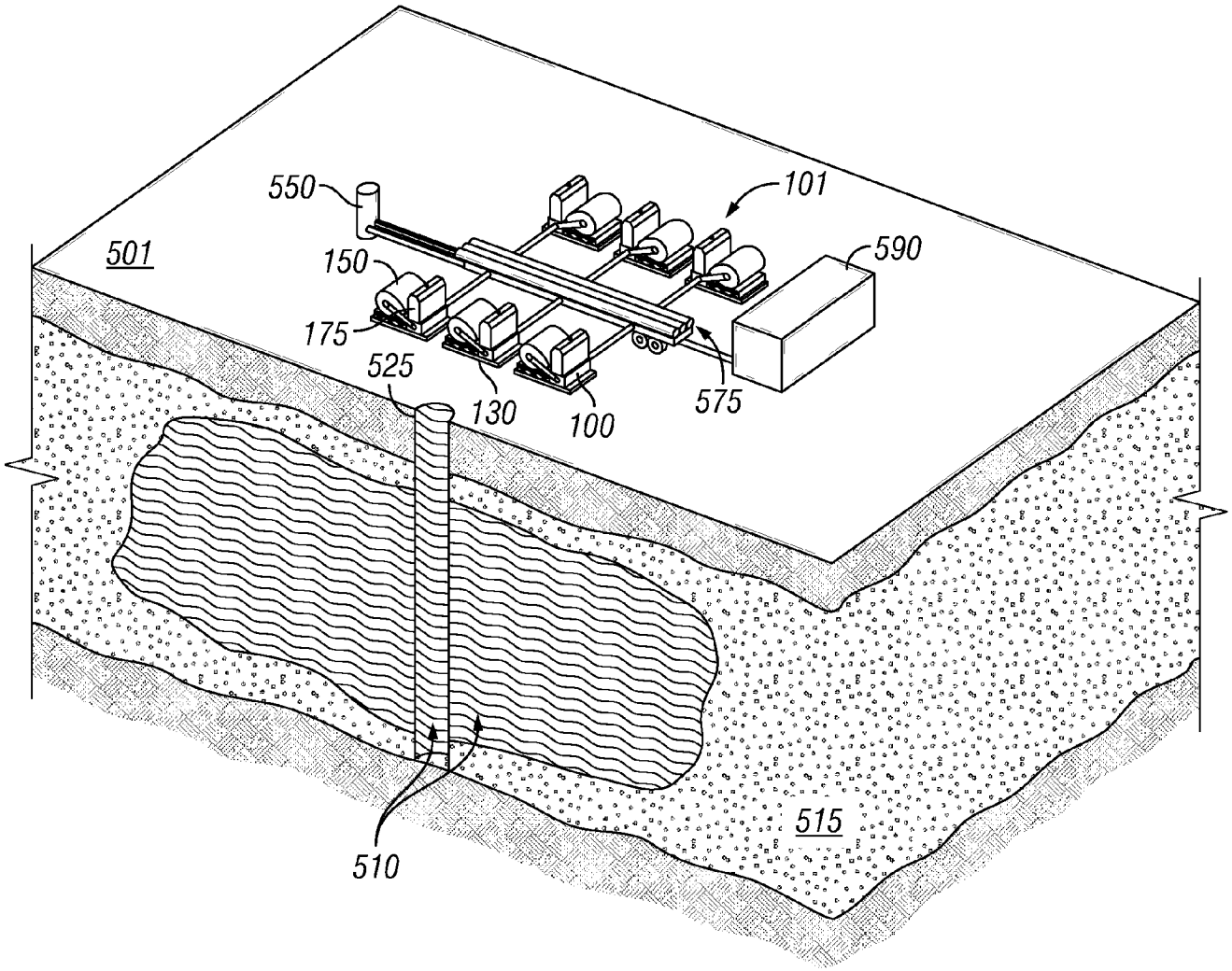
FIG. 5 is a partially sectional overview of an oilfield employing the pump of FIG. 1 as part of a multi-pump operation.

Referring now to FIG. 5, a partially sectional view of an oilfield 501 is depicted whereat pumps 101 such as that of FIG. 1 are employed as part of a multi-pump operation. Each pump 101 is equipped with a crankshaft housing 150 adjacent a chamber housing 175 and positioned atop a skid 130. However, in order to reduce cavitation and pump damage, the pumps 101 are also each equipped with an externally positioned guide assembly 100 to assist in valve actuation within the chamber housing 175 as detailed in embodiments above. Overall pump efficiency may also be enhanced for each of the pumps 101 in this manner. Thus, inadequate operation of any given pump 101 is unlikely to occur or place added strain on neighboring pumps 101.

In the particular depiction of FIG. 5, the pumps are acting in concert to deliver a fracturing fluid 510 through a well 525 for downhole fracturing of a formation 515. In this manner, hydrocarbon recovery from the formation 515 may be stimulated. Mixing equipment 590 may be employed to supply the fracturing fluid 510 through a manifold 575 where pressurization by the pumps 101 may then be employed to advance the fluid 510 through a well head 550 and into the well 525 at pressures that may exceed about 20,000 PSI. Nevertheless, due to cavitation avoidance as a result of the employed guide assemblies 100, pump damage due to water hammering may be kept at a minimum.

Embodiments described herein above address cavitation, pump damage and even pump efficiency in a manner that does not rely solely upon internal pump pressure for valve actuation. As a result, delay in opening of the suction valve in particular may be avoided so as to substantially eliminate cavitation and subsequent water hammering. Indeed, as opposed to mere monitoring of pump conditions, embodiments described herein may be employed to actively avoid pump damage from water hammering.

Figure 6:
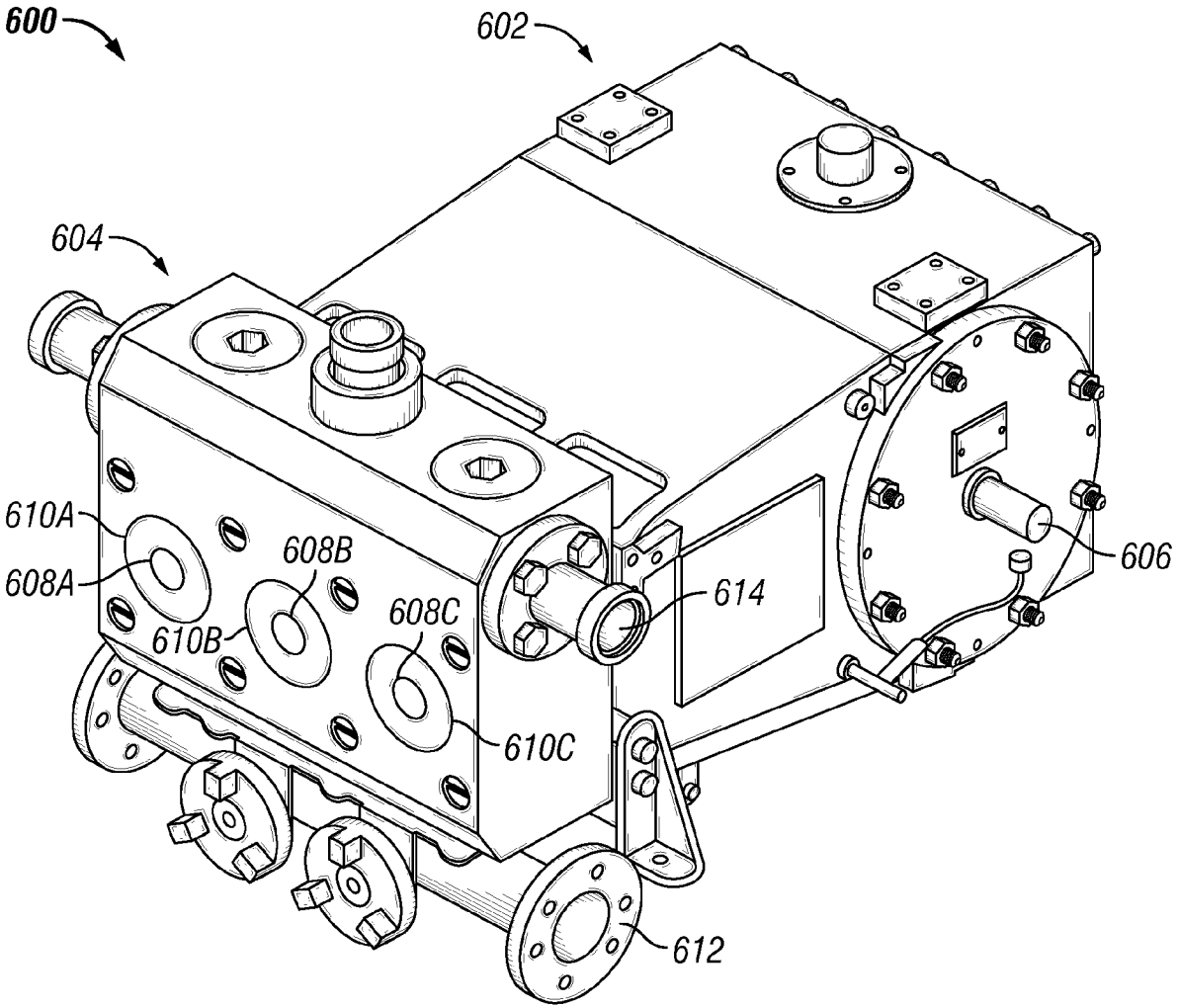
FIG. 6 is a schematic perspective view of an embodiment of a pump assembly.
Figure 7:
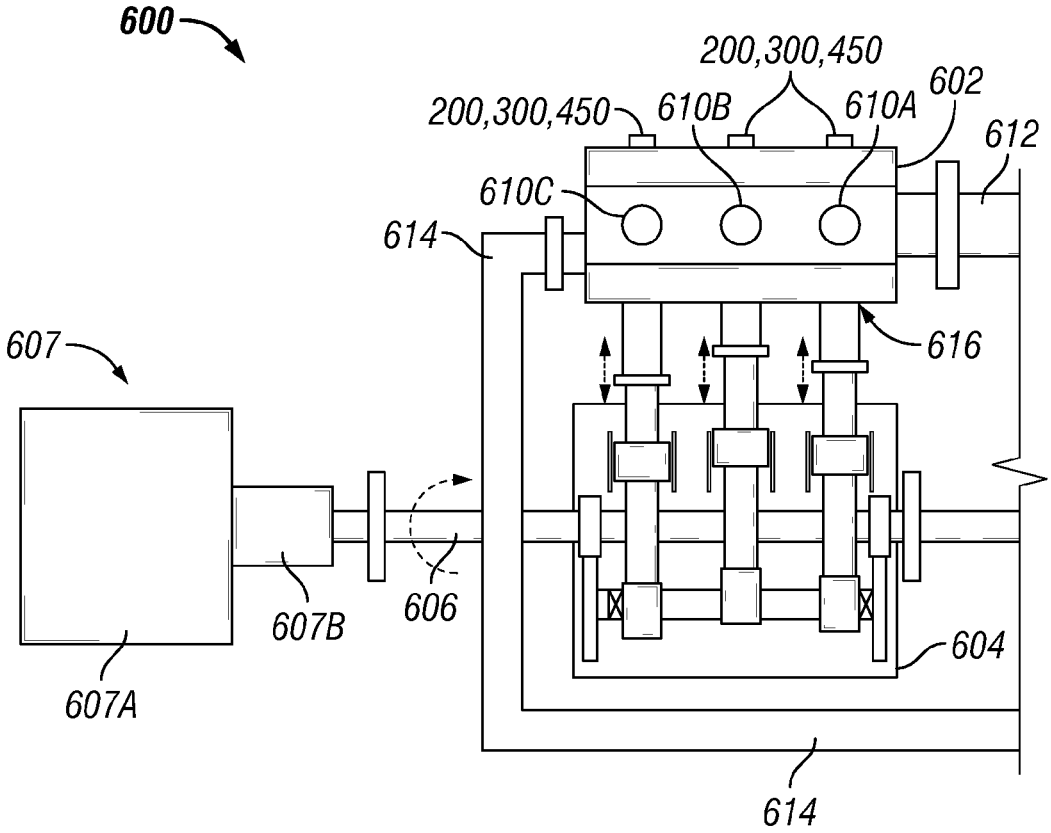
FIG. 7 is a schematic block diagram of an embodiment of a pump assembly.

In an embodiment, a pump assembly, such as the pump assembly 101 shown in FIG. 1, comprises a triplex pump assembly, such as that shown in FIGS. 6 and 7 and indicated generally at 600. The pump assembly 600 contains two sections, a power end 602 and a fluid end 604. The power end 602 contains a crankshaft 606 powered by a motor assembly 607 comprising an engine 607*a* and a transmission 607*b* to drive the pump plungers 608A-608C; and the fluid end 604 contains the cylinders 610A-610C into which the plungers 608A-608C reciprocate to draw in a fluid at low pressure from a suction manifold 612 and to discharge the fluid at a high pressure to a discharge manifold 614. The discharge manifold 614 may be in fluid communication with the well head 550 and the well 525. Those skilled in the art will appreciate that the pump assembly 600 may comprise a quintuplex pump assembly, comprising five plungers and cylinders, or any suitable number of plungers and cylinders.

Figure 9A:
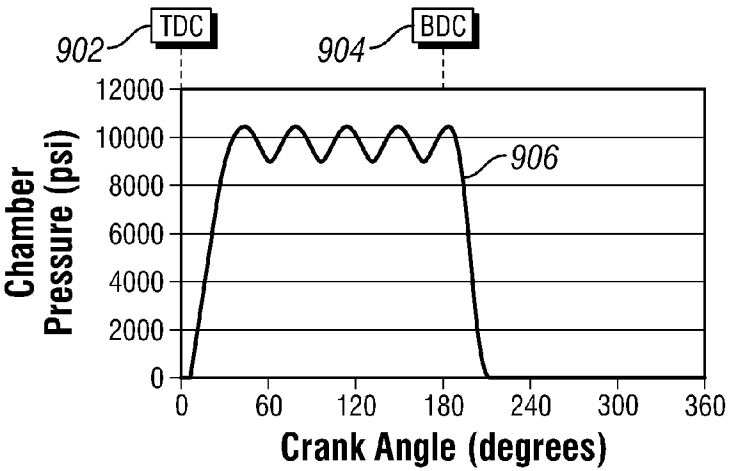
FIGS. 9*a*-12*d* are schematic timing diagrams, respectively, showing chamber pressure, percent open for suction and discharge valves, and discharge flow for embodiments of a pump assembly in various stages of operation.
Figure 9B:
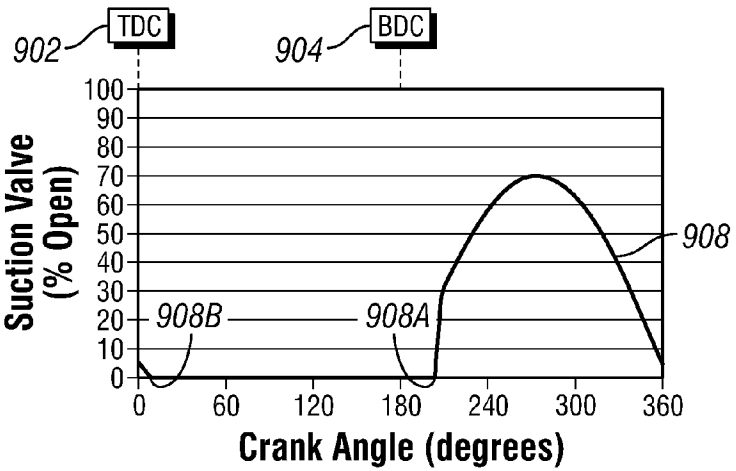
Figure 9C:
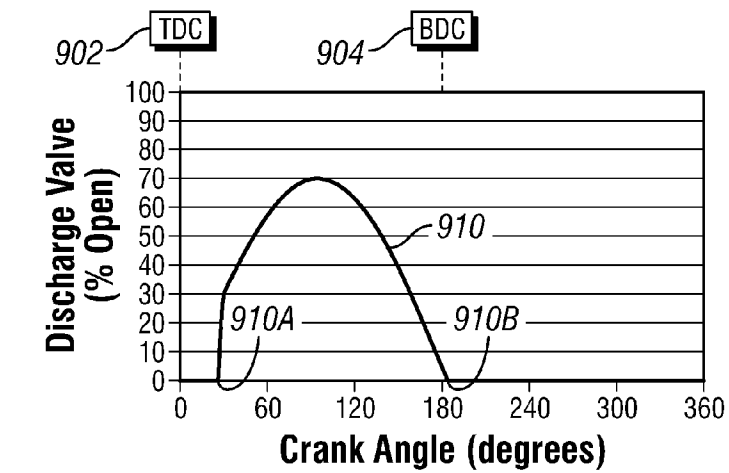
Figure 9D:
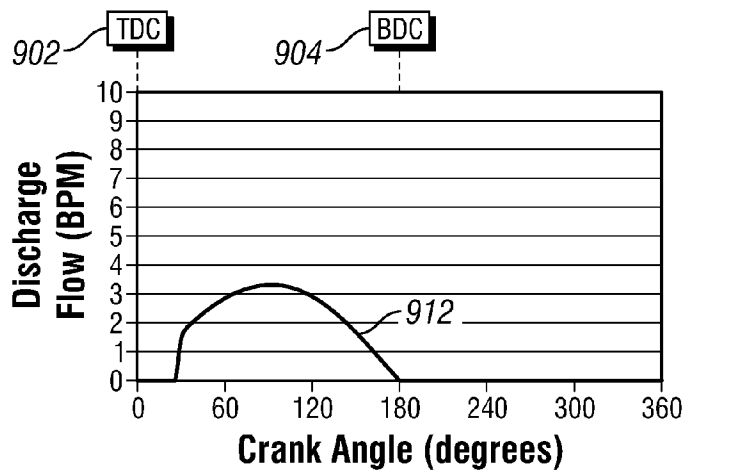
Figure 12A:
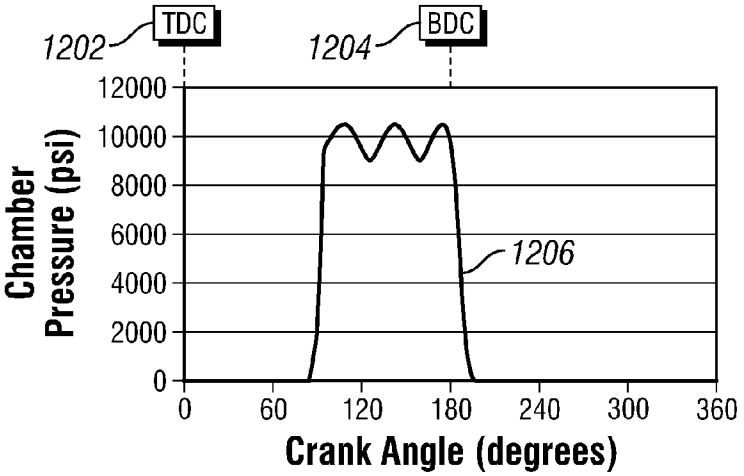
Figure 12B:
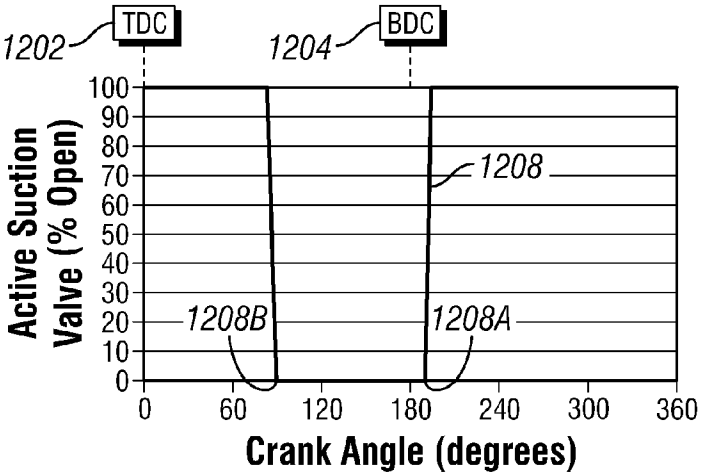
Figure 12C:
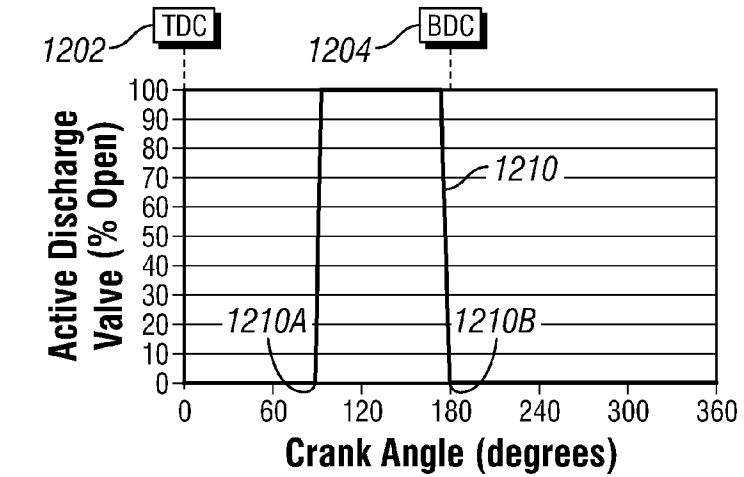
Figure 12D:
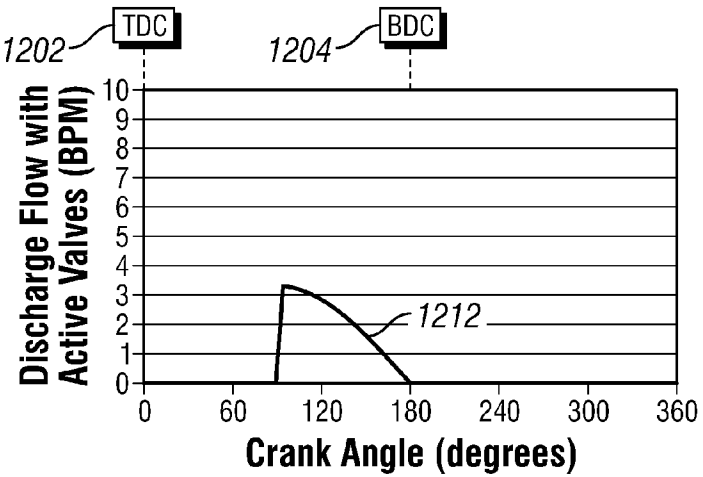

Each of the cylinders 610A-610C includes a suction valve 255 and a discharge valve 250. The suction valves 255 and the discharge valves 250 route the fluid from the suction manifold 612 to the discharge manifold 614 during operation of the pump assembly 101, as discussed hereinabove. As noted above, a typical valve arrangement of a fluid end includes suction valves 255 and discharge valves 250 biased by springs 275 and 270 that open or close based on the pressure within the pressurizable chamber 235. In such a typical valve arrangement, a normal operation with normal valve duration or timing based on the position of the plunger 290, the spring constant of the springs 275 and 270 may be determined. Such normal valve duration is typically expressed in terms of degrees of rotation of the crankshaft 606. Referring now to FIGS. 9*a*-9*d*, chamber pressure 906, suction valve percent open 908, discharge valve percent open 910, and discharge flow 912 are shown on timing diagrams with respect to crank angle and top dead center 902 (at approximately 0 degrees crank angle) and bottom dead center 904 (at approximately 180 degrees crank angle). As seen in FIG. 9*b*, a normal suction valve duration may begin at a point 908*a* (at approximately 200 degrees crank angle) and end at a point 908*b* (at approximately 5 degrees crank angle), to define a duration of approximately 165 degrees of crankshaft rotation. Similarly, a normal discharge valve duration may begin at a point 910*a* (at approximately 30 degrees crank angle) and end at a point 910*b* (at approximately 185 degrees crank angle), to define a duration of approximately 150 degrees of crankshaft rotation in the discharge stroke, which is defined as the displacement of the plunger of the pump from TDC (902) to BDC (904). In the pump assembly 600, at least one of each pair of suction valves 255 and discharge valves 250 may be controlled by a valve actuation guide, such as the valve actuation guide or guides 200, 300, or 450 to effect a change in the normal operation of the valves 255 or 250, such as opening or closing the valve 255 or 250 earlier or later than would occur in the normal valve duration, such as by increasing or decreasing the valve duration with respect to the normal valve duration shown in FIGS. 9*a*-9*d*. The actuation guide or guides 200, 300, or 450 may be operable to actuate the valves 255 or 250 in an opening direction, a closing direction, or both. Referring now to FIGS. 12*a*-12*d*, there is shown chamber pressure 1206, suction valve percent open 1208, discharge valve percent open 1210, and discharge flow 1212 on timing diagrams with respect to crank angle and top dead center 1202 and bottom dead center 1204. As seen in FIG. 12*b*, an increased suction valve duration may begin at a point 1208*a* (at approximately 190 degrees crank angle) and end at a point 1208*b* (at approximately 90 degrees crank angle), to define a duration of approximately 260 degrees of crankshaft rotation. Similarly, a decreased discharge valve duration may begin at a point 1210*a* (at approximately 90 degrees crank angle) and end at a point 1210*b* (at approximately 180 degrees crank angle), to define a duration of approximately 90 degrees of crankshaft rotation. When compared to FIG. 9, it is seen that when the suction valves and discharge valves 255 or 250 are opened at points 1208*a* and 1210*a*, respectively, the percent open is about 100 percent and remains at about 100 percent open through the valve duration, compared to a maximum percent open of about 70 percent in FIGS. 9*b* and 9*c*. Furthermore, the curves 908 and 910 are substantially parabolic, as the valve opening depends only the combination of pressure and spring 275 tension, discussed in more detail below.

Referring to FIGS. 11*a*-12*d*, it is shown that the suction and discharge valves move from fully closed to fully open and vice versa with very little delay (i.e. few degrees of crankshaft rotation). In addition to increasing or decreasing the valve timing, the ability to close the valve 255 or 250 without any delay may be equally beneficial, such as by improving the volumetric efficiency of the pump assembly 600, reduce driveline torque fluctuations, and may allow the pump assemblies to run at a greater speed. Furthermore, it may also be beneficial to be able to open the valves 255 or 250 completely as shown at 1108 and 1110 in FIGS. 11*b* and 11*c* and at 1208 and 1210 in FIGS. 12*b* and 12*c* rather than partial opening FIGS. 9*a*-9*d* (depending only the combination of pressure and spring tension), which may reduce valve erosion wear and thereby reduce the net positive suction head (NPSH) requirement of the pump assembly 600. The flow 1112 shown in FIG. 11*d* shows an increased volumetric efficiency when compared to the flow 912 shown in FIG. 9*d*, as the total flow 1112 (the area under the curve 1112) is greater than the total flow 912 (the area under the curve 912).

In an embodiment, all but one of the suction valves 255 may be held open by their respective valve actuation guide or guides 200, 300, or 450. In such an embodiment, the pump assembly 600 becomes a single cylinder pump because with the suction valve 255 held open, the plunger 290 of the cylinders 610A, 610B or 610C forces fluid back into the suction header 612 and not into the discharge header 614 through the discharge valve 250. The corresponding discharge valves 250 for the cylinders 610A, 610B or 610C may also be held closed for the cylinders 610A, 610B or 610C that have the suction valve 255 held open, such as when conducting a line pressure test after rigging up at a wellsite. By pumping with only one cylinder active, the outlet pressure of the pump assembly 600 may be controlled more easily and thereby avoid a risk of over-pressurizing the line being tested.

Figure 10A:
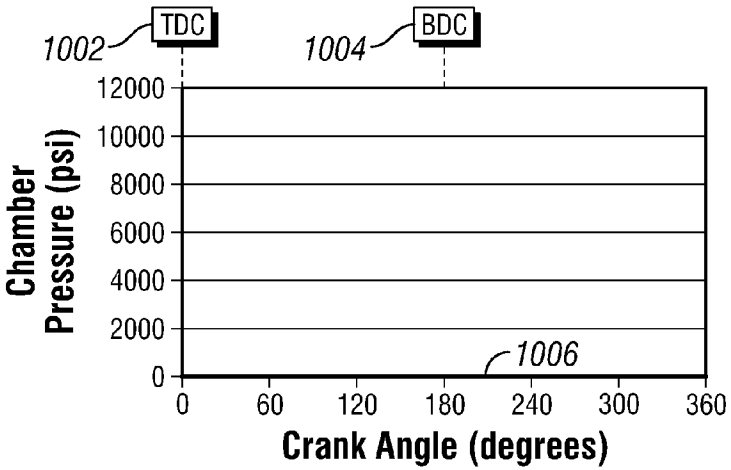
Figure 10B:
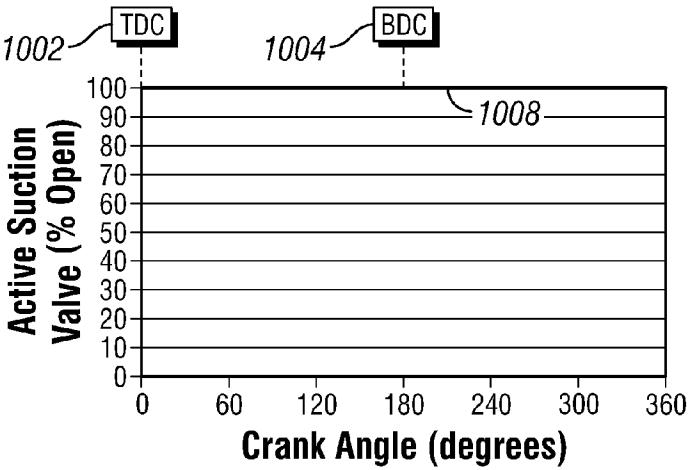
Figure 10C:
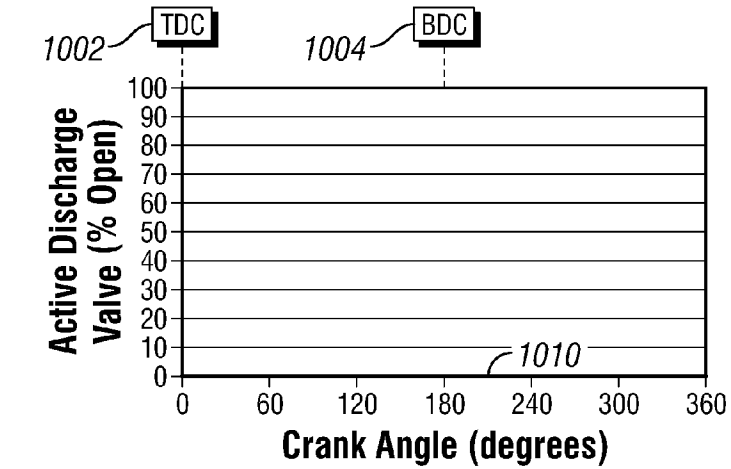
Figure 10D:
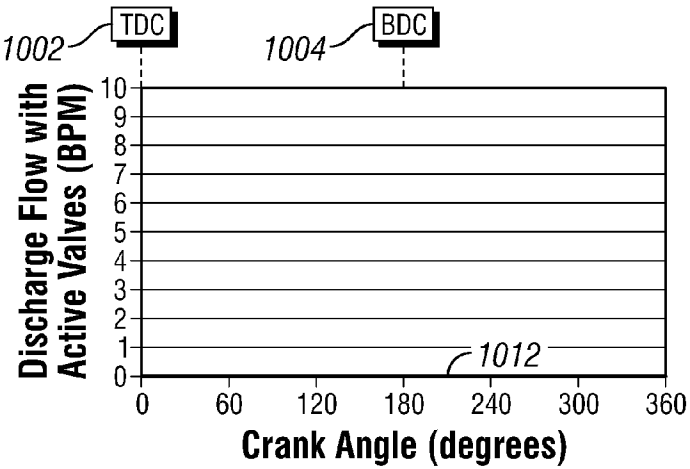
Figure 11A:
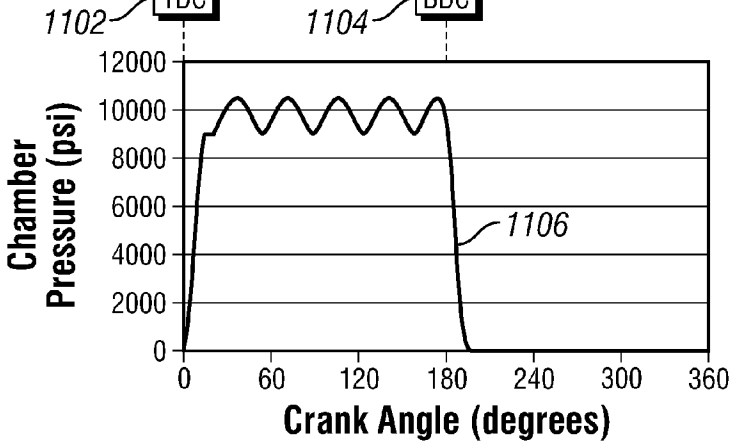
Figure 11B:
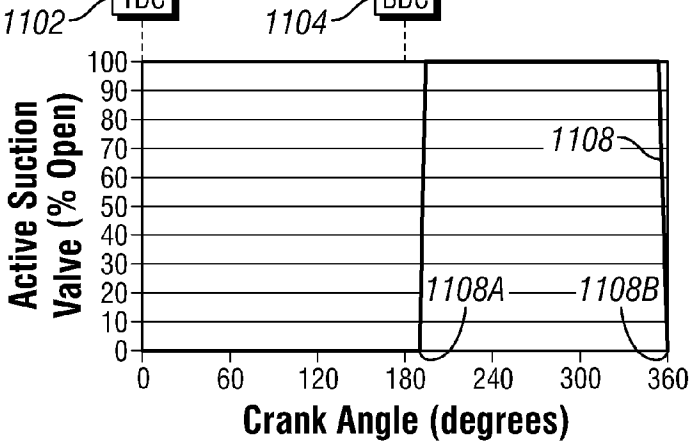
Figure 11C:
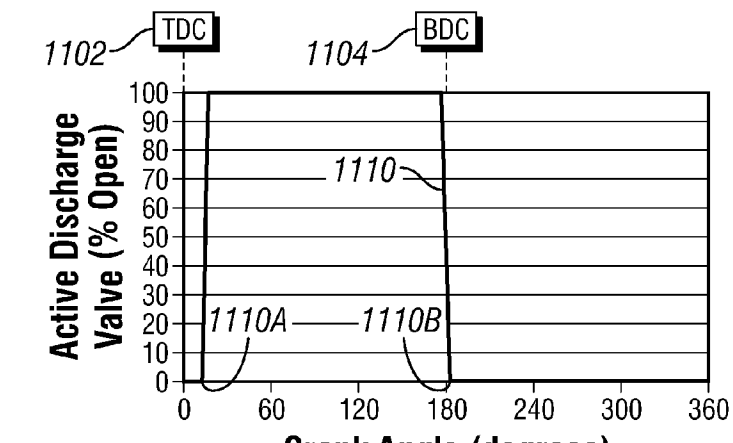
Figure 11D:
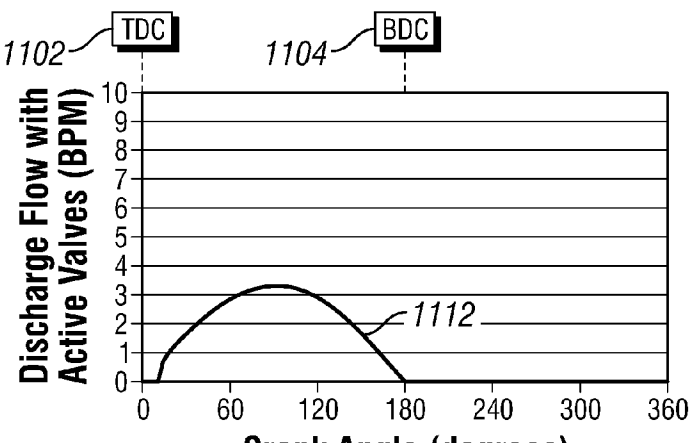

In an embodiment, a pump assembly, such as the pump assembly 600, is operated to provide pressurized fluid or the like to the discharge manifold 614. During operation, the number of cylinders 610A, 610B, and 610C that are actively pumping fluid may be varied by engaging or disengaging the respective valve actuation guide or guides 200, 300, or 450 for each cylinders 610A, 610B, and 610C. In this manner, the fluid end 604 may act in a manner similar to a transmission for the pump assembly 600 such that the gearing of the transmission 607*b* need not be changed during operation of the pump assembly 600. The number of cylinders 610A, 610B, and 610C that are active or actively pumping fluid may be varied to match the required torque and rate to the prime mover or engine 607*a* in lieu of changing gears in the transmission 607*b*. In an embodiment, the pump assembly 600 may not comprise a transmission 607*b* and the torque may be varied by activating and deactivating the number of cylinders 610A, 610B, and 610C that are active or actively pumping fluid. An activated cylinder, as defined herein, is a cylinder that is actively pumping fluid to the discharge manifold 614 and a deactivated cylinder is a cylinder that is not pumping fluid to the discharge manifold 614. Referring now to FIGS. 10*a*-10*d*, there is shown chamber pressure 1006, suction valve percent open 1008, discharge valve percent open 1010, and discharge flow 1012 on timing diagrams with respect to crank angle and top dead center 1002 and bottom dead center 1004. As seen in FIG. 10*b*, the suction valve remains at about 100 percent open for about 360 degrees of crankshaft rotation. Similarly, the discharge valve remains closed for about 360 degrees of crankshaft rotation. The cylinder shown in the timing diagrams of FIGS. 10*a*-10*d*, therefore, is deactivated and not pumping any fluid as shown in FIG. 10*d*. This may provide additional flexibility in the operation of the pump assembly 600, as will be appreciated by those skilled in the art.

In an embodiment, the respective valve actuation guide or guides 200, 300, or 450 for the valves 255 and 250 of each of the cylinders 610A, 610B, and 610C are actuated during the operation of the pump assembly 600 to vary the valve duration of the valves 255 and 250 of the pump assembly 600. The valve actuation guide or guides 200, 300, or 450 may be actuated to close the suction valve or valves 255 early in the pressure stroke (compared to a non-active valve) and thereby reduce the valve duration, which may increase the pumping rate of the pump assembly 600. The valve actuation guide or guides 200, 300, or 450 may be activated to close the suction valve or valves 255 later in the pressure stroke (compared to a non-active valve) and thereby increase the valve duration, which may decrease the pumping rate of the pump assembly 600, while ensuring that the pressurizable chamber 235 is not over-pressurized, such as by ensuring that at no time would both valves 255 or 250 be closed while the plunger 290 is in the pressure stroke. In an embodiment, the valve actuation guide or guides 200, 300, or 450 may be activated to close the suction valve or valves 250 later in the pressure stroke (compared to a non-active valve) thereby increasing the valve duration, whereby a higher pressure may be achieved due to the favorable geometry of the crank after max torque position.

In an embodiment, the respective valve actuation guide or guides 200, 300, or 450 for the valves 255 and 250 of each of the cylinders 610A, 610B, and 610C are actuated during the operation of the pump assembly 600 to delay or accelerate the valve duration of the valves 255 and 250 of the pump assembly 600. In such an embodiment, the valve duration is not increased or decreased but occurs earlier in the rotation of the crankshaft 606 (when accelerating the valve duration) or later in the rotation of the crankshaft 606 (when delaying the valve duration).

In an embodiment, the valve actuation guide or guides 200, 300, or 450 may be activated to keep the suction valve or valves 255 open and/or prevent the suction valve or valves 255 from closing, which may allow only pressure from the suction header 612 to be present on the packing 616 around the pump rods and thereby limit potential leaking around the packing 616. In addition, if it is determined that a valve 255 or 250 of one of the cylinders 610A, 610B or 610C is damaged or otherwise faulty, this cylinder 610A, 610B or 610C may be deactivated or shut down by forcing the valves 255 to remain open or closed and the pump assembly 600 may continue operation with the remaining cylinders 610A, 610B or 610C in normal operation. The deactivation of the cylinders 610A, 610B or 610C may be in response to a signal from a controller 620, discussed in more detail below. Such a signal may be, but is not limited to, a signal from a diagnostic sensor, a signal from control software of the pump assembly 600, a manual input from an operator, or the like.

In an embodiment, the valve actuation guide or guides 200, 300, or 450 may be activated to close the suction valve or valves 255 later in the pressure stroke (compared to a non-active valve) thereby increasing the valve duration or delaying the start of the valve duration, which may allow a cylinder 610A, 610B or 610C to be pressure tested.

In an embodiment, the respective valve actuation guide or guides 200, 300, or 450 for the valves 255 and 250 of each of the cylinders 610A, 610B, and 610C are actuated during the operation of the pump assembly 600 to vary the valve duration of the valves 255 and 250 of the pump assembly 600 in order to reduce the maximum amplitude vibration in the discharge header 614 as well as to improve volumetric efficiency of each of the cylinders 610A, 610B and 610C such as by varying the closing times of the discharge valves 250 to reduce vibration induced in the discharge header 614 and by ensuring that the valves 255 and 250 are closed quickly and/or without delay.

In an embodiment, the closing timing of the respective valve actuation guide or guides 200, 300, or 450 for the valves 255 of each of the cylinders 610A, 610B, and 610C may be increased during the operation of the pump assembly 600 in order to reduce the amount of fluid pumped in each cylinder 610A, 610B, and 610C and thereby reduce the suction head required for the pump assembly 600.

In an embodiment, the respective valve actuation guide or guides 200, 300, or 450 for the valves 255 and 250 of each of the cylinders 610A, 610B, and 610C are actuated during the operation of the pump assembly 600 to vary the valve duration of the valves 255 and 250 of the pump assembly 600 in order to generate and send pressure pulses in the discharge header 614 and further into the well 525 for, for example, communicating with a device (not shown) disposed within the well 525, as will be appreciated by those skilled in the art.

Figure 8:
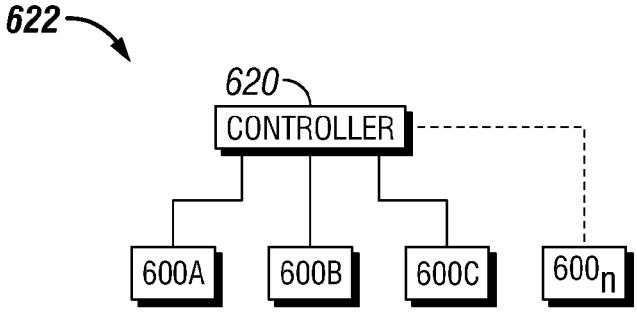
FIG. 8 is a schematic block diagram of an embodiment of a plurality of pump assemblies.

In an embodiment, a plurality of pump assemblies 600, such as the pump assemblies 600*a*, 600*b*, 600*c*, $600_n$, best seen in FIG. 8, may each be linked or otherwise suitably connected to a controller 620 to form a pumping assembly 622. The controller 620 of the pumping assembly 622 may control each of the pump assemblies 600*a*, 600*b*, 600*c*, $600_n$, to achieve a desired pumping rate, a desired pumping pressure, or the like.

In an embodiment, the respective valve actuation guide or guides 200, 300, or 450 may force the valves 255 to remain open and/or force the valves 250 to remain closed for one or more the cylinders 610A, 610B, and 610C during the operation of the pump assembly 600 in order to prevent an overpressure event for the cylinders 610A, 610B, or 610C, which may replace or supplement the use of burst discs in the fluid end 604, while ensuring that the pressurizable chamber 235 is not over-pressurized, such as by ensuring that at no time would both valves 255 or 250 be closed while the plunger 290 is in the pressure stroke.

In an embodiment, the respective valve actuation guide or guides 200, 300, or 450 for the valves 255 and 250 of each of the cylinders 610A, 610B, and 610C may be sequentially actuated during operation of the pump assembly 600 such that only one of the cylinders 610A, 610B and 610C is active in order to perform diagnostic testing on the active cylinder 610A, 610B, or 610C and its respective valves 255 and 250, including, but not limited to, packing inspection, valve degradation, valve failure prediction, and the like.

In an embodiment, the respective valve actuation guide or guides 200, 300, or 450 may force the valves 255 to remain open and/or force the valves 250 to remain for one or more the cylinders 610A, 610B, and 610C during the operation of the pump assembly 600 in order to provide cavitation protection in the event that suction pressure decreases during operation in order to keep fluid flowing from the pump assembly 600 and prevent damage to components of the fluid end 604.

In an embodiment, the respective valve actuation guide or guides 200, 300, or 450 for the valves 255 and 250 of each of the cylinders 610A, 610B, and 610C are actuated during the operation of the pump assembly 600 to vary the valve duration of the valves 255 and 250 of the pump assembly 600 in order to generate pulses with the fracturing fluid 510 within the well 525, which may improve or enhance fracture propagation within the formation 515. The opening of the suction valves 255 and/or the discharge valves 250 may be synchronized to generate the pulse or resonance within the fracturing fluid 510.

In an embodiment, the respective valve actuation guide or guides 200, 300, or 450 for the suction valves 255 of each of the cylinders 610A, 610B, and 610C may force the valves 255 to remain open until the pressurizable chamber 235 is filled with fluid or primed, which may allow for improved priming of the fluid end 604.

In an embodiment, for the suction valves 255 of each of the cylinders 610A, 610B, and 610C may force the valves 255 to remain open until the pressurizable chamber 235 is filled with fluid or primed, which may reduce the need to recirculate fluid from the discharge manifold 614 back to the suction manifold.

In an embodiment, the respective valve actuation guide or guides 200, 300, or 450 for the valves 255 and 250 of each of the cylinders 610A, 610B, and 610C are actuated during the operation of the pump assembly 600 to vary the valve duration of the valves 255 and 250 of the pump assembly 600 such that the cylinders 610A, 610B, and 610C may be activated (pump), deactivated (not pump), or pump for only a portion of the stroke of the plunger 290 in order to improve torque fluctuation of the fluid end 604.

The valves 255 or 250 of the pump assembly 600 may be operated and/or controlled in a manner to provide a desired characteristic in the pumped material or fluid system downstream of the pump assembly 600. The valves 255 or 250 of the pump assembly 600 may be operated in a manner to provide a desired characteristic within the pump assembly 600, such as the fluid end body 604. The valves 255 or 250 of the pump assembly 600 may be operated and/or controlled in a manner to provide desired characteristics for observing the operation of the pump assembly 600. The valves 255 or 250 of the pump assembly 600 may be operated and/or controlled in a manner to enable a quicker or safer setup of a pump assembly 600 for operation. The valves 255 or 250 of the pump assembly 600 may be operated and/or controlled such that multiple pumps (such as those shown in FIG. 8) may be operated to produce a desired characteristic of the pumped material or fluid system downstream of the pump assembly 600, such as within the wellbore 525, within the pump assembly 600.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A method for operating at least one pump in a pump assembly, comprising:

providing a pump assembly comprising a fluid end and a power end, the fluid end in communication with a fluid source and at least one downstream destination and comprising a pump housing for a pressurizable chamber, at least one valve for controlling fluid communication with the chamber, the at least one valve defining a normal duration of allowing fluid communication with the chamber during operation of the pump assembly;

providing a valve actuation guide external to the chamber, the valve actuation guide coupled to the valve and operable to assist in controlling fluid communication with the chamber;

operating the pump assembly; and actuating the valve actuation guide to change an aspect of the valve duration so as to create a pressure pulse utilized for sending a telemetric pressure signal to the at least one downstream destination.

2. The method of claim 1 wherein actuating further comprises changing an operating property of one of the pump assembly and a downstream destination.

3. The method of claim 1 wherein actuating comprises reducing the valve duration below the normal valve duration.

4. The method of claim 1 wherein actuating comprises increasing the valve duration above the normal valve duration.

5. The method of claim 1 wherein actuating comprises delaying the valve duration with respect to the normal valve duration.

6. The method of claim 1 wherein the actuating comprising accelerating the valve duration with respect to the normal valve duration.

7. The method of claim 1 wherein providing a valve actuation guide comprises providing an electromagnetic power source coupled to at least one electromagnetic inductor and wherein the valve is of a magneto-responsive material.

8. The method of claim 1 wherein providing a valve actuation guide comprises providing a mechanical arm disposed between the valve and the valve actuation guide, the mechanical arm coupling the valve and valve actuation guide.

9. The method of claim 1 wherein actuating changes an operating property in the fluid end in the pump.

10. The method of claim 1 wherein actuating changes a pumping rate of the pump assembly.

11. The method of claim 1 wherein actuating changes a torque output of the pump assembly.

12. The method of claim 1 wherein actuating changes a vibration output of the pump assembly.

13. The method of claim 1 wherein actuating comprises deactivating at least one of the valves and performing at least one diagnostic test on the pump assembly.

14. The method of claim 13 wherein the diagnostic test comprises a one of a pressure test and a leak test.

15. The method of claim 1 wherein actuating comprises actuating the valve to deactivate the chamber.

16. The method of claim 15 wherein deactivating comprises deactivating the chamber in response to a signal from the pump assembly.

17. The method of claim 1 wherein actuating changes a suction head of the pump assembly.

18. The method of claim 1 wherein actuating allows the chamber to be primed with the fluid source.

19. A method for operating at least one pump in a pump assembly, comprising:

providing a pump assembly comprising a fluid end and a power end, the fluid end in communication with a fluid source and at least one downstream destination and comprising a pump housing defining a plurality of cylinders each pressurizable by a piston driven by the power end, at least a pair of valves for controlling fluid communication to and from the cylinders, the valves defining a normal duration of controlling fluid communication with the chamber during operation of the pump assembly, the fluid end;

providing a valve actuation guide external to the chamber, the valve actuation guide coupled to at least one of the valves and operable to assist in controlling fluid communication with the chamber;

operating the pump assembly; and actuating the valve actuation guide to change an aspect of the valve duration and change an operating property of the pump assembly so as to create a pressure pulse utilized for sending a telemetric pressure signal to the at least one downstream destination.

20. The method of claim 19 wherein actuating changes an operating property of a downstream destination.

21. A method for operating at least one pump in a pump assembly, comprising:

providing a pump assembly, the pump assembly comprising:

a fluid end in communication with a fluid source and at least one downstream destination and comprising a pump housing defining a plurality of cylinders, and at least one suction valve and one discharge valve for controlling fluid communication to and from the cylinders, and a piston disposed in the cylinders for pressurizing the cylinders; and a power end for driving the pistons, the suction and discharge valves defining a normal duration of controlling fluid communication with the cylinder during operation of the pump assembly;

providing a valve actuation guide external to at least one of the cylinders, the valve actuation guide coupled to one of the suction valve and the discharge valve and operable to assist in controlling fluid communication with the cylinder;

operating the pump assembly; and actuating the valve actuation guide to change an aspect of the valve duration so as to create a pressure pulse utilized for sending a telemetric pressure signal to the at least one downstream destination.

22. The method of claim 21 wherein actuating changes an operating property of one of the pump assembly and a downstream destination.

23. The method of claim 21 wherein the fluid source comprises an oilfield fluid and the at least one downstream destination comprises a wellbore.

24. The method of claim 23 further comprising routing the oilfield fluid to the wellbore and performing at least one well services operation.

* * * * *